US009278051B2

(12) United States Patent
Inoue et al.

(10) Patent No.: US 9,278,051 B2
(45) Date of Patent: Mar. 8, 2016

(54) METHOD FOR REINFORCING WEAK SEALED PORTION OF MULTI-CHAMBER MEDICAL CONTAINER

(75) Inventors: Fujio Inoue, Naruto (JP); Isamu Tateishi, Naruto (JP); Akihito Togawa, Tokushima (JP); Tatsuro Tsuruoka, Tokushima (JP)

(73) Assignee: OTSUKA PHARMACEUTICAL FACTORY, INC., Naruto-Shi (JP)

( * ) Notice: Subject to any disclaimer, the term of this patent is extended or adjusted under 35 U.S.C. 154(b) by 1240 days.

(21) Appl. No.: 12/084,821

(22) PCT Filed: Nov. 24, 2006

(86) PCT No.: PCT/JP2006/323474

§ 371 (c)(1),
(2), (4) Date: May 8, 2009

(87) PCT Pub. No.: WO2007/063777

PCT Pub. Date: Jun. 7, 2007

(65) Prior Publication Data

US 2009/0325771 A1 Dec. 31, 2009

(30) Foreign Application Priority Data

| | | |
|---|---|---|
| Nov. 29, 2005 | (JP) | 2005-010046 U |
| Mar. 31, 2006 | (JP) | 2006-002383 U |
| Mar. 31, 2006 | (JP) | 2006-098135 |
| Apr. 11, 2006 | (JP) | 2006-108891 |
| Sep. 14, 2006 | (JP) | 2006-249890 |
| Oct. 30, 2006 | (JP) | 2006-294575 |
| Nov. 1, 2006 | (JP) | 2006-297954 |

(51) Int. Cl.
*A61J 1/20* (2006.01)
*A61J 1/10* (2006.01)

(52) U.S. Cl.
CPC . *A61J 1/2093* (2013.01); *A61J 1/10* (2013.01); *A61J 1/202* (2015.05); *A61J 1/2024* (2015.05)

(58) Field of Classification Search
CPC ..... A61J 1/2093; A61J 1/202; A61J 1/2024; A61J 1/10
USPC ..... 493/210, 217, 220, 212, 230, 238, 267
See application file for complete search history.

(56) References Cited

U.S. PATENT DOCUMENTS

| | | | | |
|---|---|---|---|---|
| 4,550,825 | A * | 11/1985 | Sutryn et al. | 206/222 |
| 4,961,495 | A | 10/1990 | Yoshida et al. | |
| 4,998,400 | A * | 3/1991 | Suzuki et al. | 53/425 |

(Continued)

FOREIGN PATENT DOCUMENTS

| | | |
|---|---|---|
| EP | 1 579 839 | 9/2005 |
| JP | 2-4671 | 1/1990 |

(Continued)

OTHER PUBLICATIONS

European Patent Office, "Extended European Search Report," EP 06 83 3278, dated Feb. 26, 2013, 7 pages.

*Primary Examiner* — Sameh Tawfik
(74) *Attorney, Agent, or Firm* — Farabow, Garrett & Finnegan, Henderson, Dunner, L.L.P.

(57) ABSTRACT

A method for reinforcing a weak sealed portion of a multi-chamber medical container by simple processing. The method for reinforcing a weak sealed portion of a multi-chamber medical container includes a multi-chamber container forming step for forming a multi-chamber medical container 10 including a first container portion 11 for containing a medicine, a second container portion 12 for containing a medical solution, an empty container portion 13, a pair of lateral side strong sealed portions 16 for forming both side ends of the container portions, a medical solution side weak sealed portion 17 for forming a partition between the first container portion 11 and the second container portion 12, and a discharge side weak sealed portion 18 for forming a partition between the first container portion 11 and the empty container portion 13; and a weak sealed portion reinforcing step for bonding a reinforcement film 20 for reinforcing the discharge side weak sealed portion 18 so as to cover the surface of the first container portion 11 and so as to be spaced in the discharge direction 14 from a first border 19 with the first container portion 11 on the discharge side weak sealed portion 18.

9 Claims, 9 Drawing Sheets

(56) References Cited

U.S. PATENT DOCUMENTS

| | | | | | |
|---|---|---|---|---|---|
| 5,176,634 | A | | 1/1993 | Smith et al. | |
| 5,267,646 | A | | 12/1993 | Inoue et al. | |
| 5,910,138 | A | | 6/1999 | Sperko et al. | |
| 6,007,529 | A | | 12/1999 | Gustafsson et al. | |
| 6,068,584 | A | * | 5/2000 | Daniels et al. | 493/210 |
| D594,970 | S | * | 6/2009 | Inoue et al. | D24/118 |
| 2004/0134802 | A1 | | 7/2004 | Inoue et al. | |
| 2005/0087456 | A1 | | 4/2005 | Oka et al. | |
| 2009/0209935 | A1 | * | 8/2009 | Inoue et al. | 604/416 |
| 2009/0299324 | A1 | * | 12/2009 | Inoue et al. | 604/410 |
| 2010/0298804 | A1 | * | 11/2010 | Inoue et al. | 604/410 |

FOREIGN PATENT DOCUMENTS

| | | |
|---|---|---|
| JP | 4-364850 | 12/1992 |
| JP | 5-509025 | 12/1993 |
| JP | 06135474 | 5/1994 |
| JP | 06042711 | 6/1994 |
| JP | 2000-504956 | 4/2000 |
| JP | 2000-510728 | 8/2000 |
| JP | 2002-136570 | 5/2002 |
| JP | 2002234101 | 8/2002 |
| JP | 2003-159310 | 6/2003 |
| JP | 2005-245677 | 9/2005 |

* cited by examiner (a)

(b)

TABLE 1

| | COMPARATIVE EXAMPLE 1 | COMPARATIVE EXAMPLE 2 | EXAMPLE 1 |
|---|---|---|---|
| |  |  |  |
| REINFORCEMENT EFFECT | X | △ | ◎ |

TABLE 2

| | COMPARATIVE EXAMPLE 3 | COMPARATIVE EXAMPLE 4 | COMPARATIVE EXAMPLE 5 |
|---|---|---|---|
| |  |  |  |
| REINFORCEMENT EFFECT | ○ | △ | × |

METHOD FOR REINFORCING WEAK SEALED PORTION OF MULTI-CHAMBER MEDICAL CONTAINER

TECHNICAL FIELD

The present invention relates to a method for reinforcing a weak sealed portion of a multi-chamber medical container for containing a plurality of medicines which will be mixed and used in an unmixed state in each container portion.

BACKGROUND ART

Medicines to be dosed to a patient by means of intravenous injection include a combination which causes degeneration due to interaction between medicines such as decomposition, discoloration, aggregation, and precipitation if they are stored in a mixed state, such as a combination of amino acid infusion and dextrose infusion, a combination of fat emulsion and electrolyte solution, and a combination of phosphoric acid-containing solution and calcium-containing solution.

For example, medicines supplied as a solid formulation include medicines such as antibiotics which cause degeneration such as decomposition and discoloration if they are stored while dissolved in advance in a solution such as a physiological salt solution.

Therefore, for storing such medicines, to prevent degeneration during storing and realize easy and aseptic mixing when the medicines are used, a multi-chamber container has been used which has a plurality of container portions capable of containing the above-described medicine combination or a combination of the above-described medicine and a solution thereof in a divided manner and capable of communicating these container portions at the time of use.

However, at recent medical care fields, the burden on medical staff is excessively great, so that medical accidents may occur such that the medical staff forgets the process to communicate the container portions of the multi-chamber container in some cases, and there is a possibility that only a part of the medicines contained in the multi-chamber container is administrated to a patient by mistake or a plurality of the medicines that have not been completely mixed are administrated to a patient.

Therefore, to prevent such medical accidents, a multi-chamber container in which container portions reliably communicate with each other and medicines contained in the container portions are reliably mixed has been demanded.

Patent Document 1 proposes a multi-chamber medical container including a plurality of container portions, a partitioning weak sealed portion that partitions the container portions, a medicine discharge port connected to the container portions, and a discharge weak sealed portion that partitions at least one of the container portions and the medicine discharge port, wherein at least one of the plurality of container portions contains a liquid medicine, the partitioning weak sealed portion and the discharge weak sealed portion are opened by increase of the pressure in the container portions, and a pressure necessary for opening the discharge weak sealed portion is higher than a pressure necessary for opening the partitioning weak sealed portion. According to this multi-chamber medical container, to discharge medicines in the multi-chamber container from the medicine discharge port, it is necessary to mix the medicines contained in the plurality of container portions partitioned by the partitioning weak sealed portion once and then open the discharge side weak sealed portion, so that the medicines contained in the container portions can be reliably mixed before they are discharged from the multi-chamber container.

[Patent Document 1] Japanese Unexamined Patent Publication No. 2002-136570

DISCLOSURE OF THE INVENTION

Problem to be Solved by the Invention

However, as in the multi-chamber medical container described in Patent Document 1, with respect to the partitioning weak sealed portion and the discharge weak sealed portion, since it is necessary to set heat-sealing conditions properly (for example, heating temperature, heating time, and pressure at the time of heat sealing) and a width of a sealed portion for each portion to be subjected to the heat sealing in order to differ in pressures necessary for opening these, that is peel strength for opening these, setting the conditions thereof results in complexity. Therefore, the process for manufacturing the multi-chamber container becomes complicated to cause a problem of the higher manufacturing cost.

Therefore, a multi-chamber container has been demanded in which the peel strengths of the weak sealed portion can be increased by easy processing without resetting the heat sealing conditions for each portion to be subjected to heat sealing and the sealed portion width for each portion to be subjected to heat sealing, that is, reinforcement of the weak sealed portion can be realized, and eventually, the container portions can be reliably communicated with each other and medicines contained in the respective container portions can be reliably mixed before the medicines are administered to a patient.

An object of the invention is to provide a method for reinforcing a weak sealed portion of a multi-chamber medical container by easy processing.

Means for Solving the Problem

A method for reinforcing a weak sealed portion of a multi-chamber medical container of the invention including:

a multi-chamber container forming step for forming a multi-chamber medical container, including; a first container portion for containing a medicine, a second container portion for containing a medical solution disposed adjacent to the first container portion, an empty container portion disposed adjacent to an opposite side of the second container portion with respect to the first container portion, a pair of lateral side strong sealed portions which are disposed while spaced from each other in a width direction crossing a medical solution discharge direction from the second container portion toward the empty container portion through the first container portion, and form both side end portions of each of the container portions, a medical solution side weak sealed portion which is provided across each of the lateral side strong sealed portions and forms a partition between the first container portion and the second container portion, and is opened when a pressure inside the second container portion becomes high, and a discharge side weak sealed portion which is provided across each of the lateral side strong sealed portions and forms a partition between the first container portion and the empty container portion, and is opened when a pressure inside the first container portion becomes high, wherein each container portion has a front surface side film and a back surface side film which are sealed by each of the sealed portions and overlapped with each other; and a weak sealed portion reinforcing step for bonding a reinforcement film for reinforcing the discharge side weak sealed portion so as to cover the surface of at least either one of the front surface side film and the back surface side film of the first container portion, and on the surfaces of the medical solution side weak sealed portion, the discharge side weak sealed portion, and the pair of lateral side strong sealed portions so as to be spaced from a first border of the discharge side weak sealed portion with the first container portion to the downstream side of the discharge direction.

According to the method for reinforcing a weak sealed portion of a multi-chamber medical container of the invention, a reinforcement film is bonded so as to cover a surface of at least either one of the front surface side film and the back surface side film of the first container portion on each of the surfaces of the sealed portions (the medical solution side weak sealed portion, the discharge side weak sealed portion, and the pair of lateral side strong sealed portions) so as to be spaced from the first border of the discharge side weak sealed portion with the first container portion to the downstream side of the discharge direction. Therefore, with respect to a pressure to spread the front surface side film and the back surface side film that form the first container portion from the inside to the outside of the first container portion, the reinforcement film always show an effect to suppress the pressure to open the discharge side weak sealed portion. As a result, the peel strength of the discharge side weak sealed portion against the pressure in the discharge direction is improved, and the discharge side weak sealed portion is reinforced. In addition, such a reinforcement effect for the discharge side weak sealed portion can be achieved by easy processing of bonding the reinforcement film as described above.

According to the present invention, even when, for example, in the multi-chamber container forming step, the medical solution side weak sealed portion and the discharge side weak sealed portion are formed under the same heat sealing conditions (for example, heating temperature, heating time, and a pressure for heat sealing), by bonding the reinforcement film as described above in the weak sealed portion reinforcement step, the peel strength of the discharge side weak sealed portion against a pressure in the discharge direction can be set higher than a peel strength of the medical solution side weak sealed portion against the pressure in the discharge direction, that is, by easy processing, the discharge side weak sealed portion can be made more difficult to be opened than the medical solution side weak sealed portion.

The first container portion of the multi-chamber medical container swells from the inside to the outside of the first container portion due to a medicine contained in the first container portion. Therefore, by bonding a reinforcement film so as to come into contact with the first border with the first container portion on the surface of the discharge side weak sealed portion, the reinforcement film may be wrinkled and the reinforcement film cannot evenly cover the surface of the first container portion, and the tension of the reinforcement film may vary between the discharge side weak sealed portion and the medical solution side weak sealed portion. However, as in the method for reinforcing the multi-chamber medical container, by bonding a reinforcement film on the discharge side weak sealed portion so as to be spaced from the first border with the first container portion to the downstream side of the discharge direction, the reinforcement film can evenly cover the surface of the first container portion, and the reinforcement film can be evenly tensioned between the discharge side weak sealed portion and the medical solution side weak sealed portion. This ensures an effect of improving the peel strength of the discharge side weak sealed portion against a pressure in the discharge direction and this can evenly exert the effect in the width direction of the discharge side weak sealed portion.

According to a multi-chamber medical container whose weak sealed portion is reinforced by using the method for reinforcing a weak sealed portion of a multi-chamber medical container of the invention, when a pressure is applied to the second container portion to open the medical solution side weak sealed portion, and the first container portion and the second container portion are opened to each other, the discharge side weak sealed portion can be prevented from being opened simultaneously. Therefore, before discharging the medical solution from the multi-chamber medical container, the medicine contained in the first container portion and the medical solution contained in the second container portion can be sufficiently mixed, and a problem in which the medicines are discharged from the multi-chamber medical container before these medicines are sufficiently mixed can be prevented. In the method for reinforcing a weak sealed portion of a multi-chamber medical container of the invention, it is preferable that the reinforcement film is bonded so as to cover surfaces of both of the front surface side film and the back surface side film.

In this case, the peel strength of the discharge side weak sealed portion against a pressure in a medical solution discharge direction can be further improved.

In this case, more preferably, the reinforcement film is (i) a gas-barrier film which blocks permeation of air and vapor, and/or (ii) a UV-barrier film which blocks penetration of ultraviolet rays.

In the case of (i), in addition to an effect of improving the peel strength of the discharge side weak sealed portion against a pressure in the medical solution discharge direction, an effect to provide the first container portion with gas barrier performance can be obtained, so that, for example, a medicine and medical solution which easily oxidizes and deteriorates due to reaction with oxygen and easily decomposes and degenerates due to flow-in of vapor can be stably contained in the first container portion.

On the other hand, in the case of (ii), in addition to the effect of improving the peel strength of the discharge side weak sealed portion against a pressure in the medical solution discharge direction, an effect to provide the first container portion with UV-barrier performance can be also obtained, so that, for example, a medicine which easily degenerates due to absorption of ultraviolet rays can be stably contained in the first container portion.

In the method for reinforcing a weak sealed portion of a multi-chamber medical container of the invention, it is further preferable that the reinforcement film is bonded on each of the lateral side strong sealed portions so as to be spaced from borders with the first container portion outward in the width direction.

That is, in this preferred embodiment, on the discharge side weak sealed portion, the reinforcement film is bonded so as to be spaced from a first border with the first container portion to an upstream side of a discharge direction, and on each of the lateral side strong sealed portions, the reinforcement film is bonded so as to be spaced from the border with the first container portion outward in the width direction.

As described above, the first container portion swells in the width direction of each sealed portion due to a medicine contained in the first container portion, however, by bonding the reinforcement film as described above, the reinforcement film can more evenly cover the surface of the first container portion, and the reinforcement film can be evenly tensioned between the discharge side weak sealed portion and the medical solution side weak sealed portion and between the lateral side strong sealed portions. Furthermore, this ensures the effect of improving the peel strength of the discharge side weak sealed portion against a pressure in the discharge direction and this can evenly exert the effect in the width direction of the discharge side weak sealed portion.

In the preferred embodiment described above, it is preferable that, on the medical solution side weak sealed portion, the reinforcement film is bonded so as to be spaced from the border with the first container portion to a downstream side of the discharge direction.

In the method for reinforcing a weak sealed portion of a multi-chamber medical container of the invention, it is preferable that the discharge side weak sealed portion of the multi-chamber medical container has an easy-opening portion which is opened more easily than other portions by a pressure that acts on the discharge side weak sealed portion when the discharge side weak sealed portion is opened.

When the medical solution side weak sealed portion of the multi-chamber medical container is opened, the first container portion and the second container portion are communicated with each other to form one wide region. Therefore, even an attempt to apply a pressure to the discharge side weak sealed portion by pressing the communicated container portions may result in a failure that the discharge side weak sealed portion cannot be effectively pressurized due to the wide region of the container portions.

However, the above described multi-chamber medical container has the easy-opening portion on the discharge side weak sealed portion, so that even if the region of the container portions is widened, the discharge side weak sealed portion can be reliably opened by a pressure that acts on the discharge side weak sealed portion.

It is preferable that the easy-opening portion has a projection where the discharge side weak sealed portion projects toward the upstream side of the discharge direction, and a second border of the projection at an upstream side end portion in the discharge direction with the empty container portion is disposed closer to the upstream side of the discharge direction than the first border of the discharge side weak sealed portion adjacent to the projection with the first container portion.

By designing the easy-opening portion as described above, the discharge side weak sealed portion can be more reliably opened by a pressure that acts on the discharge side weak sealed portion.

Two or more easy-opening portions may be provided on the discharge side weak sealed portion.

Effect of the Invention

According to the invention, by performing easy processing of bonding there inforcement film as described above, the peel strength of the discharge side weak sealed portion with respect to the pressure in the direction of discharging the medical solution from the second container portion to the empty container portion through the first container portion can be improved, and the reinforcement of the weak sealed portion of the multi-chamber medical container can be realized at low cost by the easy method.

DESCRIPTION OF REFERENCE NUMERALS

Figure 1:
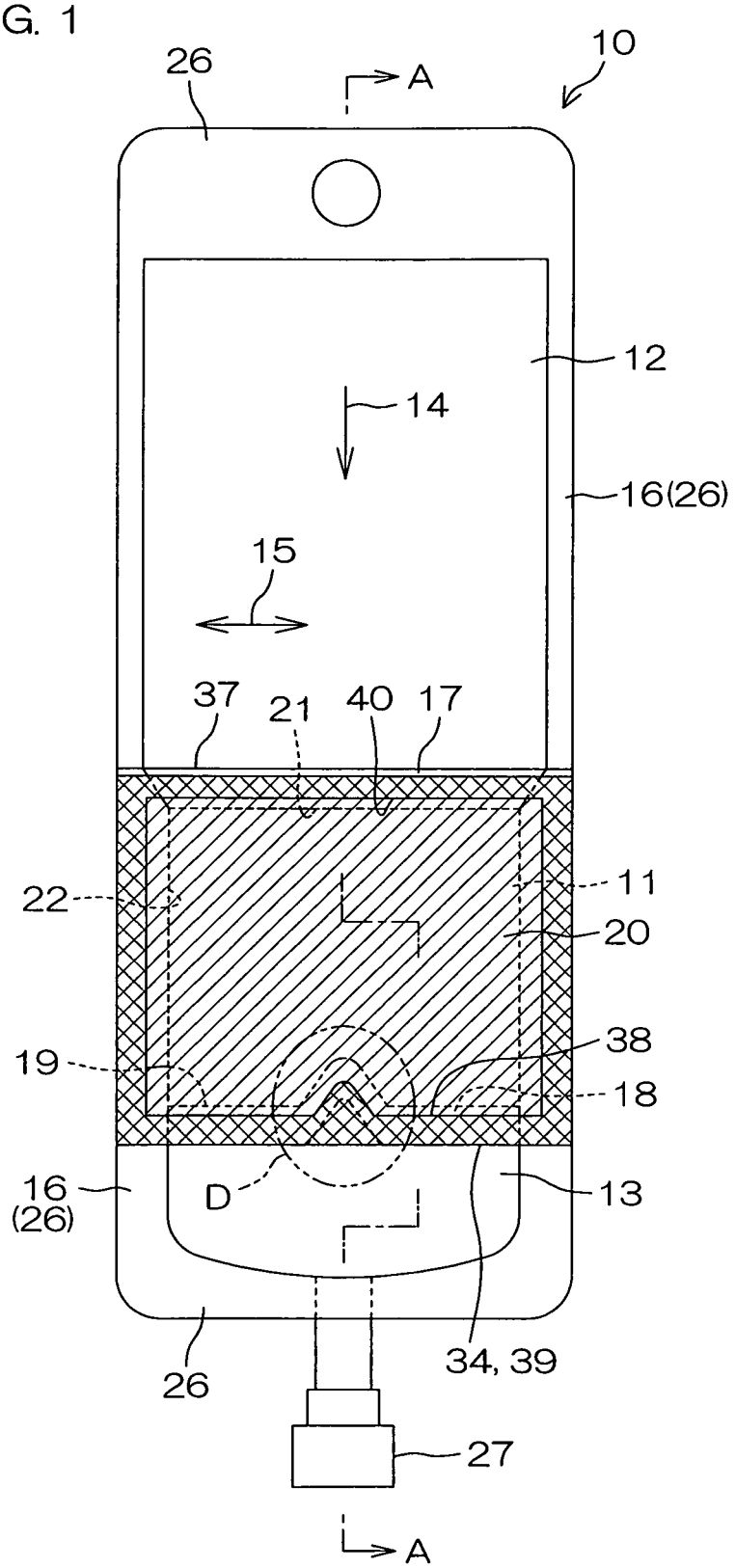
FIG. 1 is a front view showing an embodiment of a multi-chamber medical container whose weak sealed portion is reinforced by a method for reinforcing a weak sealed portion of a multi-chamber medical container according to the invention.

10 multi-chamber medical container
11 first container portion
12 second container portion
13 empty container portion
14 discharge direction
15 width direction
16 lateral side strong sealed portion
17 medical solution side weak sealed portion
18 discharge side weak sealed portion
19 first border
20 reinforcement film
21 border
22 border
23 thickness direction
24 front surface side film
25 back surface side film
26 medical solution
27 medicine
30 portion to which reinforcement film 20 is bonded
31 portion to which reinforcement film 20 is bonded
32 easy-opening portion
33 projection
34 second border Embodiment Of The Invention Hereinafter, an embodiment of the invention will be described with reference to the accompanying drawings.

Figure 2:
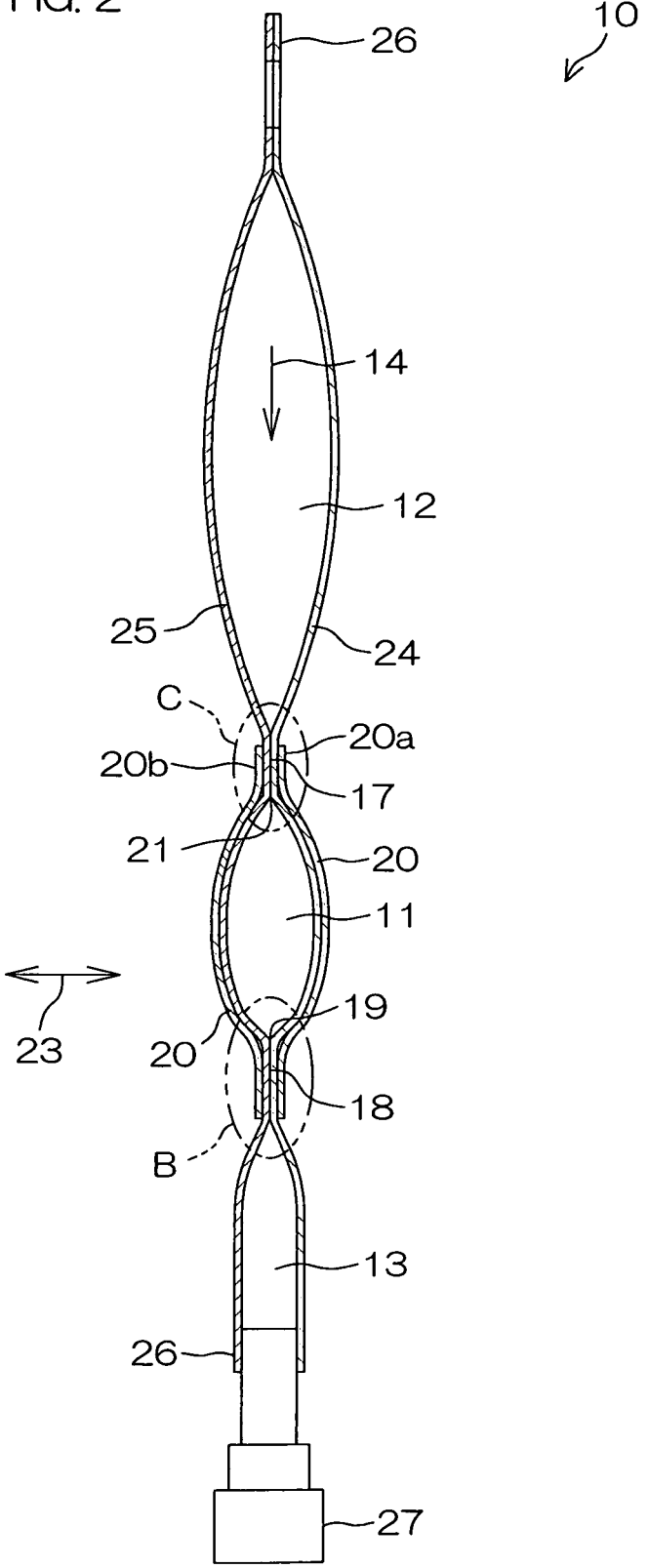
FIG. 2 is a sectional view on the A-A line of the multi-chamber medical container of FIG. 1.

Referring to FIG. 1 and FIG. 2, a multi-chamber medical container 10 includes:

- a first container portion 11 for containing a medicine;
- a second container portion 12 for containing a medical solution disposed adjacent to the first container portion 11;

an empty container portion 13 disposed adjacent to the first container portion 11 and opposite side of the second container portion 12 with respect to the first container portion 11;

a pair of lateral side strong sealed portions 16 which are disposed while spaced from each other in a width direction 15 crossing a medical solution discharge direction 14 from the second container portion 12 through the first container portion 11 toward the empty container portion 13;

a medical solution side weak sealed portion 17 which is provided across each of the lateral side strong sealed portions 16 and forms a partition between the first container portion 11 and the second container portion 12, and is opened when a pressure inside the second container portion 12 becomes high;

a discharge side weak sealed portion 18 which is provided across the lateral side strong sealed portions 16 and forms a partition between the first container portion 11 and the empty container portion 13, and is opened when a pressure inside the first container portion 11 becomes high; and a reinforcement film 20 which is bonded onto the pair of lateral side strong sealed portions 16, the medical solution side weak sealed portion 17, and the discharge side weak sealed portion 18 to reinforce the discharge side weak sealed portion 18, wherein each of the container portions (that is, the first container portion 11, the second container portion 12, and the empty container portion 13) are sealed by each of the sealed portions (that is, the lateral side strong sealed portions 16, the medical solution side weak sealed portion 17, and the discharge side weak sealed portion 18), respectively, and have a front surface side film 24 and a back surface side film 25 overlapping each other.

On the discharge side weak sealed portion 18, the reinforcement film 20 for reinforcing the discharge side weak sealed portion 18 is bonded so as to be spaced from a border (first border) 19 with the first container portion 11 to a downstream side of the discharge direction 14, and on the medical solution side weak sealed portion 17, the reinforcement film 20 is bonded so as to be spaced from a border 21 with the first container portion 11 to an upstream side of the discharge direction 14, and on each of the lateral side strong sealed portions 16, the reinforcement film 20 is bonded so as to be spaced from borders 22 with the first container portion 11 outward in the width direction 15.

Furthermore, on each of the sealed portions to which the reinforcement film 20 is bonded (that is, the pair of lateral side strong sealed portions 16, the medical solution side weak sealed portion 17, and the discharge side weak sealed portion 18), the reinforcement film 20 is bonded onto both of the surface on one side (front surface side film 24) in a thickness direction 23 of each sealed portion and the surface on the other side (back surface side film 25) opposite to the side surface 24.

In FIG. 2, a discharge port 27 described later is shown not in a sectional view but in a side view appearance.

Figure 3:
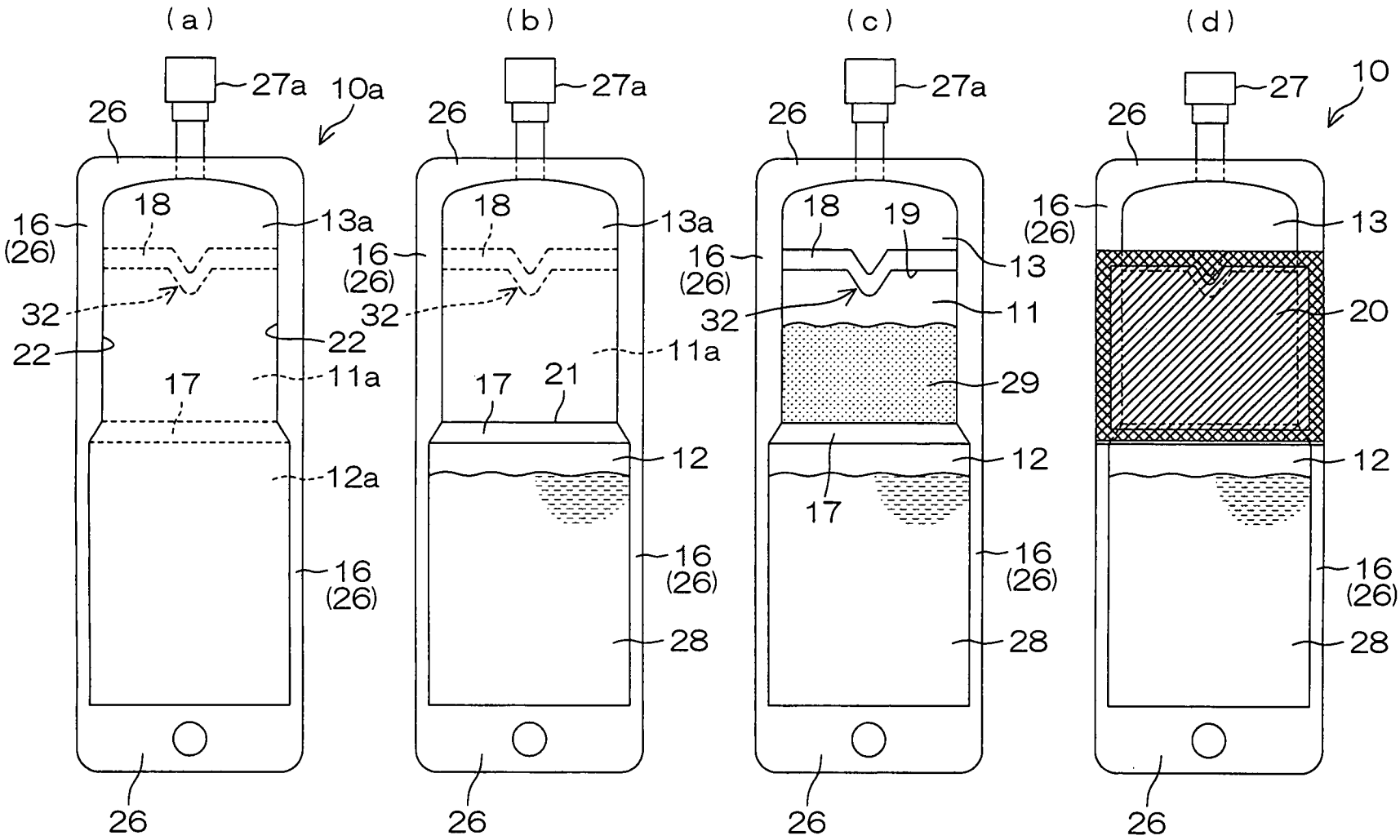
FIG. 3(*a*) through FIG. 3(*d*) are explanatory views showing an example of procedures of a multi-chamber container forming step and a weak sealed portion reinforcing step in the method for reinforcing a weak sealed portion of a multi-chamber medical container according to the invention.

The multi-chamber medical container 10 can be formed by, for example, the procedures shown in FIG. 3(*a*) through FIG. 3(*d*).

First, referring to FIG. 3(*a*), two resin films are overlapped, and in this overlapping state, the peripheries of the resin films are heat-sealed to form a peripheral strong sealed portion 26 including a pair of lateral side strong sealed portions 16. Thereby, a container 10*a* in which a medical solution side weak sealed portion 17 and a discharge side weak sealed portion 18 have not been formed is formed. In the peripheral strong sealed portion 26 of the container 10*a* thus formed, to a portion to be communicated with a portion 13*a* to be an empty container portion, a discharge port 27 which is formed in a cylindrical shape and is tightly stopped is attached in advance.

Next, referring to FIG. 3(*b*), into a portion 12*a* to be a second container, a medical solution 28 is poured from a discharge port 27*a* before being tightly stopped, and a medical solution side weak sealed portion 17 is formed by heat sealing.

Furthermore, referring to FIG. 3(*c*), a medicine 29 is poured into a portion 11*a* to be a first container portion from the discharge port 27*a* before being tightly stopped, and a discharge side weak sealed portion 18 is formed by heat sealing. Thereafter, the discharge port 27 is tightly stopped to form the multi-chamber container (multi-chamber container forming step).

Next, referring to FIG. 3(*d*), in the formed multi-chamber container, a reinforcement film 20 for reinforcing the discharge side weak sealed portion 18 is bonded onto the surfaces of each of the sealed portions including the medical solution side weak sealed portion 17, the discharge side weak sealed portion 18, and the pair of lateral side strong sealed portions 16 (weak sealed portion reinforcing step).

At this time, the reinforcement film 20 is bonded on the discharge side weak sealed portion 18 so as to be spaced from a first border 19 with the first container portion 11 to the downstream side of the discharge direction 14, on the medical solution side weak sealed portion 17 so as to be spaced from a border 21 with the first container portion 11 to the upstream side of the discharge direction 14, and on the respective lateral side strong sealed portions 16 so as to be spaced from borders 22 with the first container portion 11 outward in the width direction 15.

In the description given above about the multi-chamber container forming step, when forming the multi-chamber medical container 10, the two resin films are overlapped. However, instead of this, one resin film may be folded and used, or a cylindrical film formed by inflation molding may be made flat and used.

Referring to FIG. 1 and FIG. 2 again, for the resin films forming the multi-chamber medical container 10, considering direct contact with a medicine contained in the first container portion and a medical solution contained in the second container portion, films made of a resin material which is medically allowed to come into contact with medicines are used.

As a resin material which is medically allowed to come into contact with the medicines, there are available resin materials which have been conventionally used for forming medical containers. In detail, for example, thermoplastic resins such as polyolefin, cyclic polyolefin, polyester, and polyamide are used, and among these, polyolefin is preferable. These thermoplastic resins may be used alone, or two or more kinds may be mixed and used.

As polyolefin, for example, polyolefin such as homopolyethylene, ethylene α-olefin copolymer, polypropylene homopolymer, propylene α-olefin random copolymer, propylene α-olefin block copolymer, etc., or a mixture of these polyolefins may be used. A film made of these polyolefins has excellent properties in medical safety, flexibility, and transparency, and its handling performance is excellent. By using the film made of polyolefin, a medicine container which is easily visible to check a state of a medicine contained in the container portion is obtained.

The resin film may be a multilayer film formed by laminating two or more films made of the above-described thermoplastic resin, or may be a multilayer film formed by laminating a film made of the above-described thermoplastic resin and other resin film.

As other resin films, for example, a resin film having a gas barrier effect (hereinafter, referred to as "gas barrier film"), and a resin film having a light shielding effect (hereinafter, referred to as "light shielding film") may be used.

As a resin material forming the gas barrier film, there are available, for example, polyvinyl alcohol (PVA), ethylene-vinyl alcohol copolymer (EVOH), polyvinyl acetate (PVAC), ethylene-vinyl acetate copolymer (EVA), polyvinyl chloride (PCV), polyvinylidene chloride (PVDC), polyglycolic acid, ethylcellulose, cellulose acetate, nitrocellulose, high-density polyethylene (HDPE), medium-density polyethylene (MDPE), nylon, polystyrene (PS), polycarbonate (PC), polyacrylonitril, etc., and among these, PVA and EVOH are preferable.

The gas barrier film may be a film including a deposited layer of inorganic oxide formed on a surface of a base film made of polyester, etc.

As the inorganic oxide forming the deposited layer of the inorganic oxide, there are available, for example, alumina (aluminum oxide), silica (silicon oxide), magnesium oxide, titanium oxide, etc., and among these, in terms of maintaining the transparency of the film, alumina is preferable.

As the light shielding film, for example, a resin film containing a colorant and an ultraviolet absorber for the purpose of lowering the light beam permeability and ultraviolet permeability of the resin film is available.

The thickness of the resin film is not especially limited, however, it is generally 100 to 300 μm, and this thickness can be increased and reduced as appropriate according to the purpose of use of the multi-chamber medical container and a mechanical strength and flexibility of the resin film. When the multi-chamber medical container is used as an infusion bag, a blood bag, an enteral feeding bag, a liquid food bag, etc., whose capacity is up to about 500 ml, although the use of the container is not limited thereto, the thickness of the resin film is preferably not more than 220 μm, and more preferably, 160 to 200 μm.

The reinforcement film 20 for reinforcing the discharge side weak sealed portion 18 is affixed onto the outer surface of the multi-chamber container as described above, and does not come into direct contact with medicines and medical solutions contained in the first container portion 11 and the second container portion 12. Therefore, a resin film forming the reinforcement film 20 is not limited to resin materials which are medically allowed to come into contact with medicines, and is selected as appropriate from various resin materials.

The resin film forming the reinforcement film 20 is preferably a resin film excellent in transparency in terms of easy visual checking of the state of a medicine in the first container portion 11. As a resin film excellent in transparency, for example, a resin film made of polyolefin is available.

The reinforcement film 20 may be a laminated film, or may be the gas barrier film or the light shielding film described above.

When the gas barrier film is used as the reinforcement film 20, the first container portion 11 can be provided with a gas barrier effect, and for example, a medicine which is oxidized and deteriorated due to reaction with oxygen and easily causes problems such as decomposition and degeneration due to flow-in of vapor can be stably stored in the first container portion 11.

As the gas barrier film, a gas barrier film similar to that described above is used. The medicines which are easily oxidized and deteriorated due to reaction with oxygen are, for example, a medicine prepared as a solid formulation described later of amino acids, vitamins, and fatty acids, etc., or a medicine prepared as a medical solution by dissolving amino acids, vitamins, and fatty acids, etc., in a solution. The medicine which easily causes a problem such as decomposition and degeneration of the medicine due to flow-in of vapor is, for example, an antibiotic.

When a light shielding film is used as the reinforcement film 20, the first container portion 11 can be provided with a light shielding effect, and for example, a medicine which easily degenerates due to absorption of UV rays can be stably contained in the first container portion 11.

As the light shielding film, the same light shielding film as described above can be used. The medicine which easily degenerates due to absorption of UV rays is, for example, a medicine prepared as a medical solution by dissolving vitamins into a solution.

The reinforcement film 20 is bonded by using an adhesive or directly fused to the surface of the multi-chamber medical container 10 (in detail, to the surfaces of the discharge side weak sealed portion 18, the medical solution side weak sealed portion 17, and the lateral side strong sealed portions 16), which will be described later.

The adhesive is not especially limited, however, for example, polyurethane resin is available, and in detail, for example, polyurethane resins made by Mitsui Chemicals Polyurethanes, Inc., (trade name: "Takelac (registered trademark)" series, trade name: "Takenate (registered trademark)" series) are available.

In the multi-chamber medical container 10, the first container portion 11 is demarcated by the pair of lateral side strong sealed portion 16, the medical solution side weak sealed portion 17, and the discharge side weak sealed portion 18. The second container portion 12 is demarcated by the pair of lateral side strong sealed portion 16, the medical solution side weak sealed portion 17, and the peripheral strong sealed portion 26 (in detail, a part of the peripheral strong sealed portion 26 arranged to face the medical solution side weak sealed portion 17 with respect to the second container portion 12). The empty container portion 13 is demarcated by the discharge side weak sealed portion 18 and the peripheral strong sealed portion 26 (in detail, a part of the peripheral strong sealed portion 26 arranged to face the discharge side weak sealed portion 18 with respect to the empty container portion 13).

The peripheral strong sealed portion 26 including the pair of lateral side strong sealed portions 16 is strongly heat-sealed so that the resin films do not easily peel off. In the peripheral strong sealed portion 26, the portion which demarcates the empty container portion 13 in conjunction with the pair of lateral side strong sealed portions 16 and the discharge side weak sealed portion 18 is strongly heat-sealed while sandwiching a cylinder of the discharge port 27 between the pair of surface and back side resin films.

The heat sealing conditions when the peripheral strong sealed portion 26 is formed are not especially limited and can be selected as appropriate in the usual manner, however, heat-sealing for 1 through 3 seconds at 130 to 170° C. is preferable.

On the other hand, the medical solution side weak sealed portion 17 and the discharge side weak sealed portion 18 are weakly heat-sealed (in detail, at a low temperature and/or for a short period of time) so that their sealing strengths to be smaller than that of the lateral side strong sealed portions 16.

The heat sealing conditions when the medical solution side weak sealed portion 17 and the discharge side weak sealed portion 18 are formed are not especially limited and can be selected as appropriate in the usual manner; however, for example, heat-sealing for 2 through 4 seconds at 110 to 160° C. is preferable.

In the first container portion 11, a solid formulation is contained as the medicine 29, and in the second container portion 12, a medical solution 28 is contained (see FIG. 3(*c*)) although they are not shown in FIG. 1 and FIG. 2 (and FIG. 4 through FIG. 6 described later).

The medical solution 28, for example, a solution such as physiological salt solution for dissolving the solid formulation contained in the first container portion 11 or various infusion solutions although the medicine is not limited to these.

The medicine 29 is a solid formulation or medical solution, etc.

The solid formulation is a medicine of one or more compounds which are, for example, powdered in the usual manner, for example, diluted in the usual manner and prepared into a formulation such as a fine granule, granule, or tablet, or for example, dissolved into water or other solvent and the solution is freeze-dried in the usual manner into a formulation such as freeze-dried powder, etc.

In FIG. 3(*c*), an example in which sa solid formulation is contained as the medicine 29 in the first container portion 11 is shown, however, the medicine to be contained in the first container portion 11 is not limited to the solid formulation, and it may be, for example, a medical solution such as various infusion solutions according to the purpose of use of the multi-chamber medical container 10.

On the other hand, in the second container portion 12, the medical solution 28 is contained. By containing the medical solution in the second container portion 12, it is possible to increase the pressure inside the second container portion 12 by pressing the second container portion 12. Furthermore, the medical solution side weak sealed portion 17 can be opened by applying a liquid pressure of the medical solution 28 to the medical solution side weak sealed portion 17.

The empty container portion 13 contains nothing and is empty before the multi-chamber medical container 10 is used.

Figure 4:
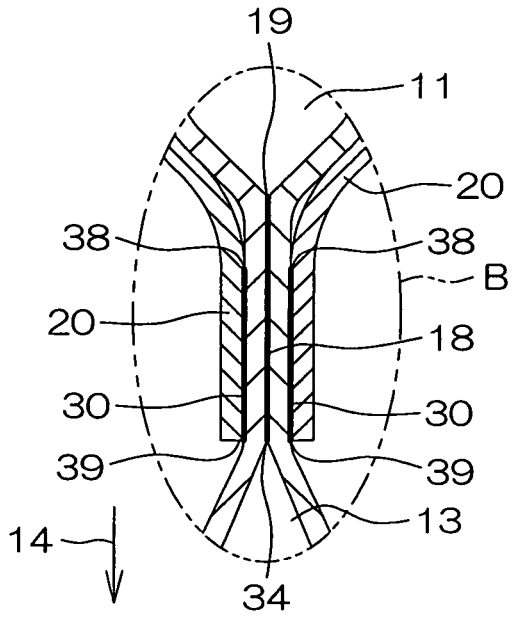
FIG. 4 is an enlarged view of the part B shown in FIG. 2.
Figure 5:
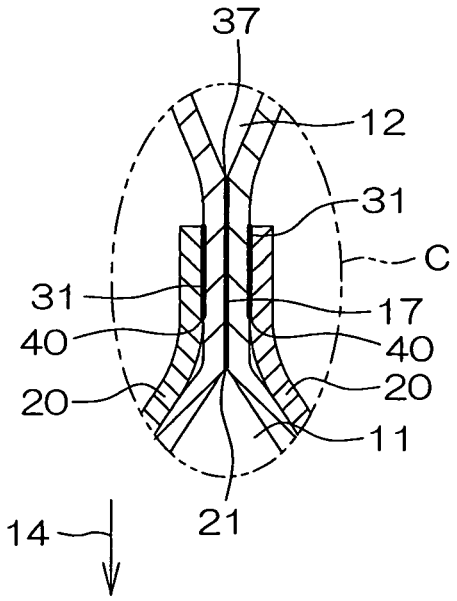
FIG. 5 is an enlarged view of the part C shown in FIG. 2.

Referring to FIG. 1, FIG. 2, FIG. 3(*a*) through FIG. 3(*d*), FIG. 4, and FIG. 5, the reinforcement film 20 is bonded to each of the surfaces of the sealed portions of the medical solution side weak sealed portion 17, the discharge side weak sealed portion 18, and the pair of lateral side strong sealed portions 16 at the weak sealed portion reinforcing step.

The reinforcement film 20 is bonded on the discharge side weak sealed portion 18 so as to be spaced from the first border 19 with the first container portion 11 to the downstream side of the discharge direction 14, on the medical solution side weak sealed portion 17 so as to be spaced from the border 21 with the first container portion 11 on the upstream side of the discharge direction 14, and on the respective lateral side strong sealed portions 16 so as to be spaced outward in the width direction 15 from the borders 22 with the first container portion 11.

In FIG. 1, the reinforcement film 20 is hatched, and the bonded portions to each of the lateral side strong sealed portions 16, the medical solution side weak sealed portion 17, and the discharge weak sealed portion 18 are cross-hatched.

In FIG. 4 and FIG. 5, the portions where the discharge side weak sealed portion 18 and the medical solution side weak sealed portion 17 are formed by bonding the resin films that form the multi-chamber medical container 10 are indicated by thick lines, and a portion 30 of the surface of the discharge side weak sealed portion 18 to which the reinforcement film 20 is bonded and a portion 31 of the medical solution side weak sealed portion 17 to which the reinforcement film 20 is bonded are also indicated by thick lines.

Referring to FIG. 4 and FIG. 5, on each of the sealed portions to which the reinforcement film 20 is bonded, the reinforcement film 20 is bonded to both of the surface on one side (front surface side film 24) in the thickness direction 23 of each sealed portion, and the surface on the other side (back surface side film 25) opposite to the surface of the side surface (front surface side film 24).

Due to the bonding of the reinforcement film 20 as shown in FIG. 4, at the discharge side weak sealed portion 18, the first container portion 11 is pressed inward from the outside and is difficult to be opened against a pressure acting in the discharge direction 14. Therefore, the discharge side weak sealed portion 18 does not open according to the opening of the medical solution side weak sealed portion 17, and before opening the discharge side weak sealed portion 18, the medicine contained in the first container portion 11 and the medical solution contained in the second container portion 12 can be sufficiently mixed.

When the reinforcement film 20 is bonded to the surface of the discharge side weak sealed portion 18, in the first container portion 11, the medicine 29 has already been contained, and the first container portion 11 has swelled in the thickness direction 23 of the sealed portions. However, the reinforcement film 20 is bonded so as to be spaced from the first border 19 between the discharge side weak sealed portion 18 and the first container portion 11 to the downstream side of the discharge direction 14 on the discharge side weak sealed portion 18, so as to be spaced from the border 21 between the medical solution side weak sealed portion 17 and the first container portion 11 to the upstream side of the discharge direction 14 on the medical solution side weak sealed portion 17, and so as to be spaced from the borders 22 between the lateral side strong sealed portions 16 and the first container portion 11 outward in the width direction 15 at the respective lateral side strong sealed portions 16.

Therefore, regardless of the degree of swelling in the thickness direction 23 of each of the sealed portions of the first container portion 11, the reinforcement film 20 can be evenly bonded to each of the sealed portions.

On the medical solution side weak sealed portion 17, a reinforcement film which is bonded from the medical solution lateral side strong sealed portion 17 to the second container portion 12 side is not provided, so that a reinforcement effect is not achieved against a pressure that acts on the medical solution side weak sealed portion 17 in the discharge direction 14. That is, the original peel strength of the weak sealed portion is maintained against a pressure which is applied to the medical solution side weak sealed portion 17 in the discharge direction 14 by pressing the second container portion 12.

Therefore, in the multi-chamber medical container, when a pressure is applied in the discharge direction 14 to the medical solution side weak sealed portion 17 by pressing the second container portion 12, the medical solution side weak sealed portion 17 can be comparatively easily opened. On the other hand, the discharge side weak sealed portion 18 is not opened in response to opening of the medical solution side weak sealed portion 17 by the pressure in the discharge direction 14.

That is, according to the multi-chamber medical container described above, for example, when the medical solution side weak sealed portion 17 is opened by pressing the second container portion 12, a problem can be prevented in which the discharge side weak sealed portion 18 is opened before medicines contained in the first container portion 11 and the second container portion 12 are sufficiently mixed.

The discharge port 27 for discharging medicines disposed in the discharge lateral side strong sealed portion 18, is a member for discharging the medicines contained in the multi-chamber medical container 10 to the outside of the multi-chamber medical container, and is not especially limited, and a discharge port which is generally used for medical containers is available.

Figure 6:
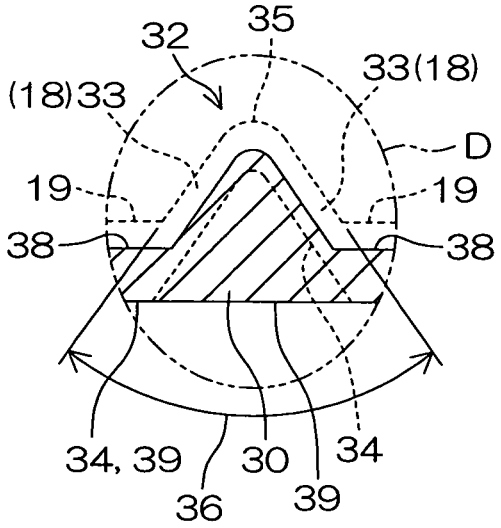
FIG. 6(*a*) is an enlarged view of the part D shown in FIG. 1, and FIG. 6(*b*) is an explanatory view showing a state that a reinforcement film 20 is removed from an easy-opening portion shown in FIG. 6(*a*)
Figure 6:
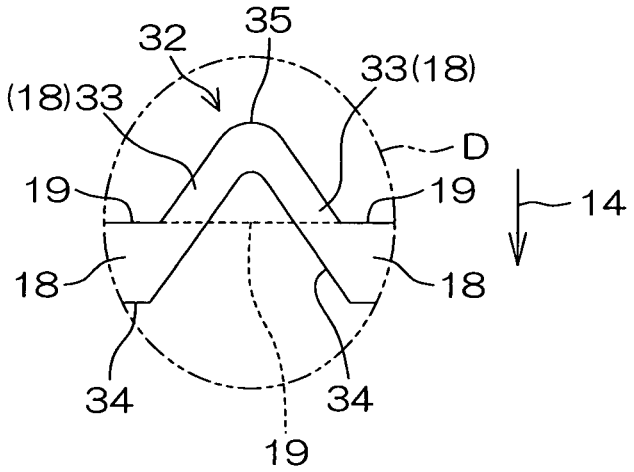

Referring to FIG. 6(*a*) and FIG. 6(*b*), the discharge side weak sealed portion 18 has an easy-opening portion 32 which is easily opened by a pressure that acts on the discharge side weak sealed portion 18 when the discharge side weak sealed portion 18 is opened.

The easy-opening portion 32 is provided at a central portion in the width direction 15 of the discharge side weak sealed portion 18 (See FIG. 1), and formed into a generally V shape as seen from the top where the discharge side weak sealed portion 18 projects toward the medical solution side weak sealed portion 17 side. This easy-opening portion 32 has a projection 33 where the discharge side weak sealed portion 18 projects toward the upstream side of the discharge direction 14, and a border (second border) 34 of the projection 33 at the upstream side end portion in the discharge direction 14 with the empty container portion 13 is disposed closer to the upstream side of the discharge direction 14 than the first border 19 of the discharge side weak sealed portion 18 adjacent to the projection 33 with the first container portion 11.

When the medical solution side weak sealed portion 17 of the multi-chamber medical container 10 is opened to open the first container portion 11 and the second container portion 12 to each other, the first container portion 11 and the second container portion 12 communicate with each other and form one wide region. Therefore, even an attempt to apply a pressure to the discharge side weak sealed portion 18 may result in failure to effectively apply a pressure to the discharge side weak sealed portion 18, due to the communicated wide region. However, when the easy-opening portion 32 is provided on the discharge side weak sealed portion 18, a pressure can be applied in a concentrated manner to the easy-opening portion 32, whereby the discharge side weak sealed portion 18 can be reliably opened.

In particular, the easy-opening portion shown in FIG. 6(*a*) and FIG. 6(*b*), the projection 33 thereof at the upstream side end portion in the discharge direction with the empty container portion 13 is disposed closer to the upstream side of the discharge direction 14 than the first boarder 19 of the discharge side weak sealed portion 18 adjacent to the projection 33 with the first container portion 11, whereby the discharge side weak sealed portion 18 can be more reliably opened.

An apex angle 36 of an apex 35 of the projection 33 is not especially limited; however, interms of easily opening of the discharge side weak sealed portion 18, it is preferably 20 to 150 degrees.

In FIG. 6(*a*), a portion 30 of the reinforcement film 20 bonded to the surface of the discharge side weak sealed portion 18 (or the empty container portion 13) is hatched.

Figure 7:
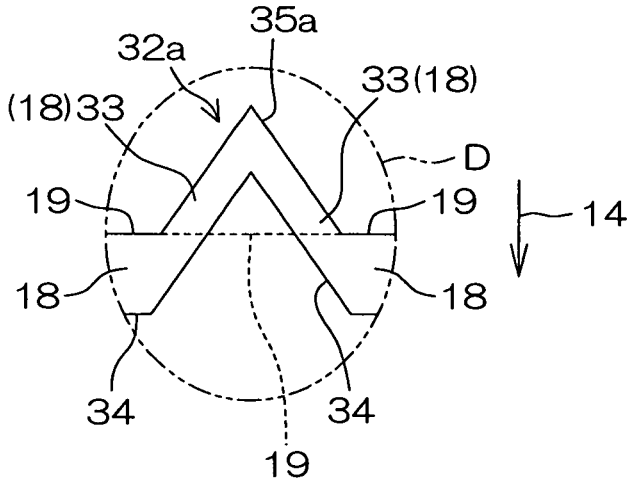
FIG. 7 is an explanatory view showing a design variation of the easy-opening portion.

Referring to FIG. 7, similar to the case in FIG. 6(*b*), the easy-opening portion 32*a* is formed into a generally V shape as seen from the top where the discharge side weak sealed portion 18 projects toward the side of the drug solution side weak sealed portion 17 side. The easy-opening portion 32*a* has a projection 33 where the discharge side weak sealed portion 18 projects toward the upstream side of the discharge direction 14, and a second border 34 of the projection 33 at the upstream side end portion in the discharge direction 14 with the empty container portion 13 is disposed closer to the upstream side of the discharge direction 14 than the first border 19 between the discharge side weak sealed portion 18 adjacent to the projection 33 and the first container portion 11.

The easy-opening portion 32*a* has a shape of the apex 35*a* of the projection 33 sharper than that of the projection 33 shown in FIG. 6(*b*). Therefore, when a pressure is applied in the discharge direction 14 to the discharge side weak sealed portion 18, the easy-opening portion 32*a* is more easily opened than the easy-opening portion 32 shown in FIG. 6.

Figure 8:
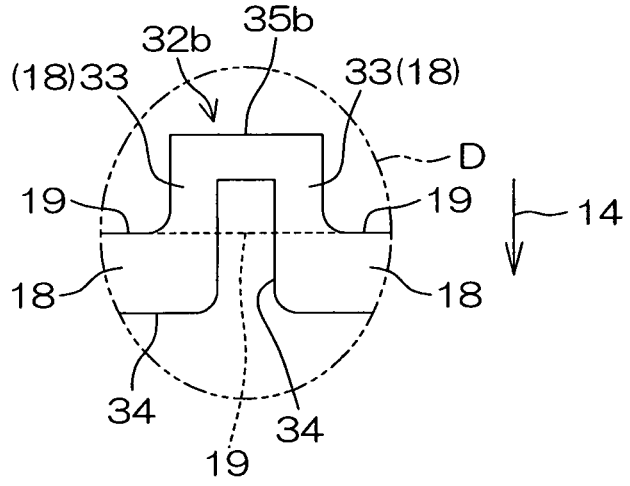
FIG. 8 is an explanatory view showing a design variation of the easy-opening portion.

Referring to FIG. 8, the easy-opening portion 32*b* has a projection 33 where the discharge side weak sealed portion 18 projects toward the upstream side of the discharge direction 14 similar to the case of FIG. 6(*b*), and a second border 34 of the projection 33 at the upstream side end portion in the discharge direction 14 with the empty container portion 13 is disposed closer to the upstream side of the discharge direction 14 than the first border 19 of the discharge side weak sealed portion 18 adjacent to the projection 33 with the first container portion 11. This easy-opening portion 32*b* is formed into a generally U shape seen from the top where the discharge side weak sealed portion 18 projects toward the medical solution side weak sealed portion 17 side, and an apex 35*b* of the projection 33 is more obtuse than the projection 33 shown in FIG. 6(*b*).

Also concerning this easy-opening portion 32*b*, in the same manner as described above, the second border 34 of the projection 33 at the upstream side end portion in the discharge direction 14 with the empty container portion 13 is disposed closer to the upstream side of the discharge direction 14 than the first border 19 on the discharge side weak sealed portion 18 adjacent to the projection 33 with the first container portion 11, so that when a pressure is applied in the discharge direction 14 to the discharge side weak sealed portion 18, the pressure can be applied in a concentrated manner to the easy-opening portion 32*b*, and the discharge side weak sealed portion 18 can be reliably opened.

Figure 9:
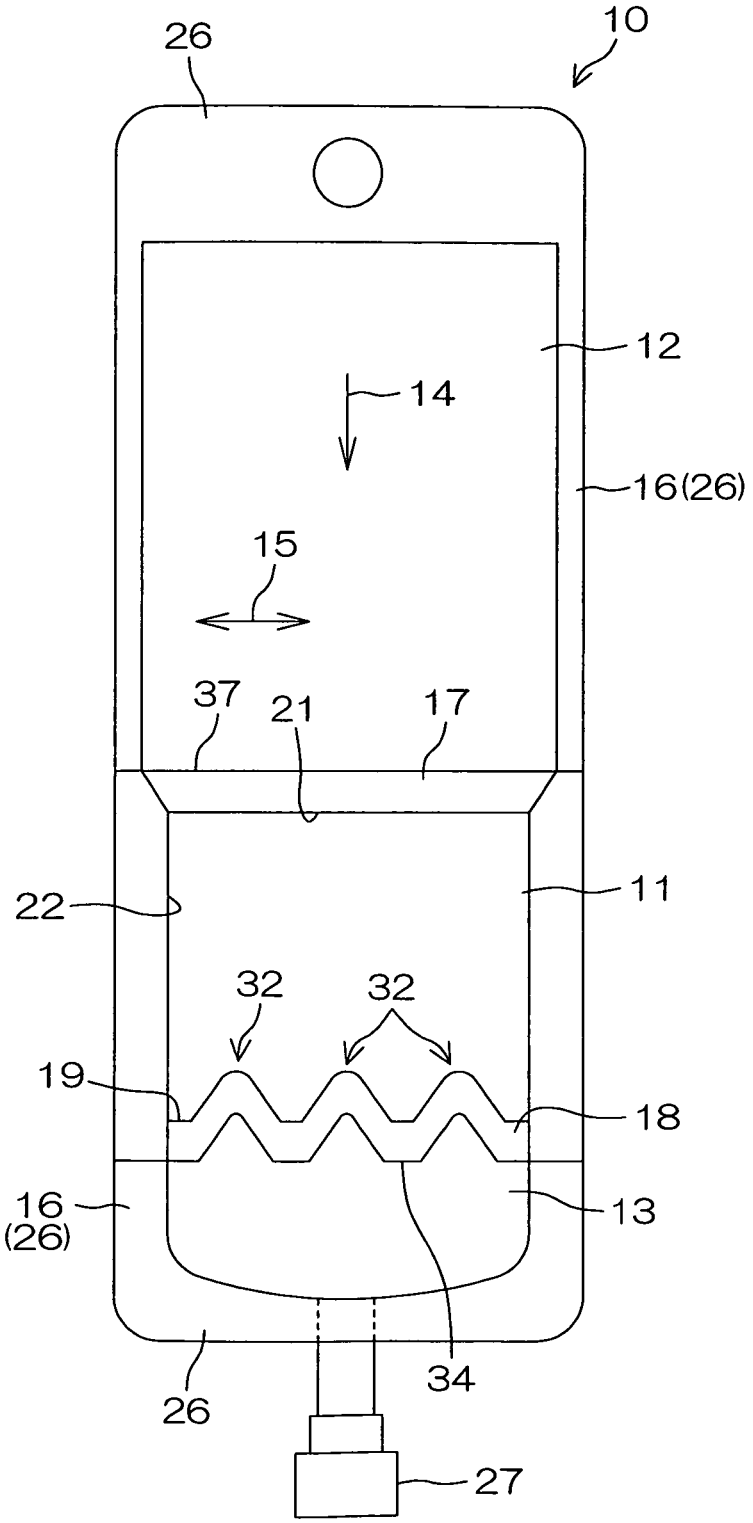
FIG. 9 is a front view showing another embodiment of a multi-chamber medical container whose weak sealed portion is reinforced by the method for reinforcing a weak sealed portion of a multi-chamber medical container according to the invention.

Referring to FIG. 9, three in total of the easy-opening portions 32 are provided at generally even intervals in the width direction 15 of the discharge side weak sealed portion 18.

By thus providing a plurality of easy-opening portions 32, when a pressure is applied to the discharge side weak sealed portion 18 in the discharge direction 14, the discharge side weak sealed portion 18 can be more reliably opened.

In the above-described embodiment, the reinforcement film 20 is provided across the two weak sealed portions on both of the surface of one side (front surface side film 24) in the thickness direction 23 of the discharge side weak sealed portion 18 and the medical solution side weak sealed portion 17 and the surface (back surface side film 25) opposite to the one side (front surface side film 24), however, the invention is not limited to this, and for example, the reinforcement film 20 may be provided on either surface of the front surface side film 24 and the back surface side film 25.

As a multi-chamber medical container, a multi-chamber container having three container portions of the first container portion 11, the second container portion 12, and the empty container portion 13 is illustrated, however, the number of container portions is not limited to this, and it may be four or more.

EXAMPLES

Hereinafter, the invention will be described by exemplifying examples of a multi-chamber medical container with reference to FIG. 1 through FIG. 5, FIG. 6(*a*), FIG. 6(*b*), Table 1, and Table 2, however, the invention is not limited to the following examples.

Materials used for manufacturing the multi-chamber medical container are as follows.

As a resin film for forming the multi-chamber medical container 10, a four-layer film with a total thickness of 200 μm including two intermediate layers made of polyethylene, and an outer layer and an inner layer made of a mixed resin of polyethylene and polypropylene was used.

As the discharge port 27, a port having a polyethylene-made cylinder and a plug made of a styrene-based thermoplastic elastomer which seals the inside of the cylinder was used.

As the reinforcement film 20, a gas barrier film with a total thickness of 200 μm having a polyethylene-made base film and an alumina deposited film formed on one side surface (outside surface) of the base film, or a polyethylene film with a thickness of 200 μm was used.

To bond the reinforcement film 20, as an adhesive, a polyurethane resin, the trade name "Takelac (registered trademark) A315" made by Mitsui Chemicals Polyurethanes, Inc., was used.

Example 1

As a first example, a multi-chamber medical container shown in the column of the first embodiment of Table 1 shown below was manufactured by the following procedures.

First, two four-layer films described above were overlapped to face the inner layers of the four-layer films each other, and the peripheral strong sealed portion 26 was formed by heat sealing for 4 seconds at 200° C. while sandwiching the cylinder of the discharge port 27 at a forming position of the discharge lateral side strong sealed portion 18. The width of the peripheral strong sealed portion 26 was set to approximately 8 mm in the width direction 15 at the lateral side strong sealed portions 16, and set to 10 mm or more in the discharge direction 14 at other portions.

Next, through the cylinder of the discharge port 27, 100 ml of a physiological salt solution was poured into a forming portion of the second container portion 12 (inner size in the discharge direction 14: approximately 130 mm, and inner size in the width direction 15: approximately 100 mm), and then the four-layer films were overlapped and subjected to heat sealing for 3 seconds at 145° C. to form the medical solution side weak sealed portion 17. Herein, the length in the discharge direction 14 of the medical solution side weak sealed portion 17 (length from a border 37 between the second container portion 12 and the medical solution side weak sealed portion 17 to the border 21 between the first container portion 11 and the medical solution side weak sealed portion 17) was set to 12 mm so that this length was even in the width direction 15.

Furthermore, through the cylinder of the discharge port 27, 1 gram of sodium cefazolin (solid formulation) was poured into a forming portion of the first container portion 11 (inner size in the discharge direction 14: approximately 70 mm, inner size in the width direction 15: 82 mm), and then the four-layer films were overlapped and subjected to heat sealing for 4 seconds at 145° C. to form the discharge side weak sealed portion 18. Herein, the length in the discharge direction 14 of the discharge side weak sealed portion 18 (length from the first border 19 between the first container portion 11 and the discharge side weak sealed portion 18 to the second border 34 between the empty container portion 13 and the discharge side weak sealed portion 18) was set to 12 mm so that this length was even in the width direction 15.

After the medical solution side weak sealed portion 17 and the discharge side weak sealed portion 18 were formed and medicines were filled in the first container portion 11 and the second container portion 12, the plug was fitted into the cylinder of the discharge port 27 and fixed, whereby a multi-chamber container containing sodium cefazolin (solid formulation) contained in the first container portion 11 and a physiological salt solution contained in the second container portion 12 was obtained.

Next, a reinforcement film 20 was bonded to the discharge side weak sealed portion 18, the medical solution side weak sealed portion 17, and each of the lateral side strong sealed portions 16 so that the first container portion 11 of the multi-chamber container was covered by the reinforcement film 20.

To bond the reinforcement film 20, a polyurethane resin, the trade name "Takelac (registered trademark)" made by Mitsui Chemicals Polyurethanes, Inc., was used.

As shown in Table 1, the reinforcement film 20 was bonded so as to be spaced by approximately 3 mm from the first border 19 between the discharge side weak sealed portion 18 and the first container portion 11 to the downstream side of the discharge direction 14 on the surface of the discharge side weak sealed portion 18. That is, on the bonded portion 30 of the reinforcement film 20, the distance between an edge 38 of the upstream side of the discharge direction 14 and the first border 19 between the discharge side weak sealed portion 18 and the first container 11 was set to approximately 3 mm. On the bonded portion 30 of the reinforcement film 20, an edge 39 of the downstream side of the discharge direction 14 was aligned with the second border 34 between the discharge side weak sealed portion 18 and the empty container portion 13.

The reinforcement film 20 was bonded so as to be spaced by approximately 5 mm from the border 21 between the medical solution side weak sealed portion 17 and the first container portion 11 to the upstream side of the discharge direction 14 on the surface of the medical solution side weak sealed portion 17. That is, on the bonded portion 31 of the reinforcement film 20, the distance from an edge 40 of the downstream side of the discharge direction 14 and the border 21 between the medical solution side weak sealed portion 17 and the first container portion was set to approximately 5 mm. Furthermore, on the surfaces of the lateral side strong sealed portions 16, the reinforcement film 20 was bonded so as to be spaced by approximately 5 mm from the borders 22 between the lateral side strong sealed portions 16 and the first container portion 11 outward in the width direction 15.

Comparative Example 1

A multi-chamber medical container was obtained in the same manner as in Example 1 except that the reinforcement film 20 was bonded as shown in the column of Comparative Example 1 of Table 1 shown below.

In detail, the reinforcement film 20 was bonded in the same manner as in Example 1 on the surfaces of the medical solution side weak sealed portion 17 and each of the lateral side strong sealed portions 16. That is, on the surface of the medical solution side weak sealed portion 17, the reinforcement film 20 was bonded so as to be spaced by approximately 5 mm from the border 21 between the medical solution side weak sealed portion 17 and the first container portion 11 to the upstream side of the discharge direction 14, and on each of the surfaces of the lateral side strong sealed portions 16, the reinforcement film 20 was bonded so as to be spaced by approximately 5 mm from the borders 22 between each of the lateral side strong sealed portions 16 and the first container portion 11 outward in the width direction 15.

On the other hand, on the surface of the discharge side weak sealed portion 18, the reinforcement film 20 was not bonded, and on the surface of the empty container portion 13, the reinforcement film 20 was bonded between a position spaced by approximately 10 mm from the second border 34 between the discharge side weak sealed portion 18 and the empty container portion 13 to the downstream side of the discharge direction 14 (upstream side edge 38 in the discharge direction 14 of the bonded portion 30) and a position spaced by approximately 15 mm from the border to the downstream side of the discharge direction 14 (downstream side edge 39 in the discharge direction 14 of the bonded portion 30).

Comparative Example 2

A multi-chamber medical container was obtained in the same manner as in Example 1 except that the reinforcement film 20 was bonded as shown in the column of Comparative Example 2 of Table 1 shown below.

In detail, the reinforcement film 20 was bonded on the surfaces of the medical solution side weak sealed portion 17 and each of the lateral side strong sealed portions 16 in the same manner as in Example 1.

On the other hand, on the surface of the discharge side weak sealed portion 18, the reinforcement film 20 was not bonded, and on the surface of the empty container portion 13, the reinforcement film 20 was bonded to a position spaced by approximately 5 mm from the second border 34 between the discharge side weak sealed portion 18 and the empty container portion 13 (upstream side edge 38 in the discharge direction 14 of the bonded portion 30) from this second border 34 to the downstream side of the discharge direction 14 (downstream side edge 39 in the discharge direction 14 of the bonded portion 30).

Comparative Example 3

A multi-chamber medical container was obtained in the same manner as in Example 1 except that the reinforcement film 20 was bonded as shown in the column of Comparative Example 3 of Table 2 shown below.

In detail, the reinforcement film 20 was bonded in the same manner as in Example 1 on the surfaces of the medical solution side weak sealed portion 17 and each of the lateral side strong sealed portions 16.

On the other hand, on the surface of the discharge side weak sealed portion 18, the reinforcement film 20 was bonded so as to completely overlap the discharge side weak sealed portion 18. That is, the upstream side edge 38 in the discharge direction 14 of the bonded portion 30 was aligned with the first border 19, and the downstream side edge 39 in the discharge direction 14 of the bonded portion 30 was aligned with the second border 34.

Comparative Example 4

A multi-chamber medical container was obtained in the same manner as in Example 1 except that the reinforcement film 20 was bonded as shown in the column of Comparative Example 4 of Table 2 shown below.

In detail, the reinforcement film 20 was bonded in the same manner as in Example 1 on the surfaces of the medical solution side weak sealed portion 17 and each of the lateral side strong sealed portions 16.

On the other hand, on the surface of the discharge side weak sealed portion 18, the reinforcement film 20 was not bonded, and on the surface of the first container portion 11, the reinforcement film 20 was bonded a position spaced by approximately 5 mm from the first border 19 between the discharge side weak sealed portion 18 and the first container portion 11 and from this first border 19 to the upstream side of the discharge direction 14 (upstream side edge 38 in the discharge direction 14 of the bonded portion 30). The downstream side edge 39 in the discharge direction 14 of the bonded portion 30 of the reinforcement film 20 was aligned with the first border 19.

Comparative Example 5

A multi-chamber medical container was obtained in the same manner as in Example 1 except that the reinforcement film 20 was bonded as shown in the column of Comparative Example 5 of Table 2 shown below.

In detail, the reinforcement film 20 was bonded in the same manner as in Example 1 on the medical solution side weak sealed portion 17 and each of the lateral side strong sealed portions 16.

On the other hand, on the surface of the discharge side weak sealed portion 18, the reinforcement film 20 was not bonded, and on the surface of the first container portion 11, the reinforcement film 20 was bonded between a position spaced by approximately 10 mm to the upstream side of the discharge direction 14 from the first border 19 between the discharge side weak sealed portion 18 and the first container 11 (downstream side edge 39 in the discharge direction 14 of the bonded portion 30) and a position spaced by approximately 15 mm from the first border 19 to the upstream side of the discharge direction 14 (upstream side edge 38 in the discharge direction 14 of the bonded portion 30).

Evaluation test

The multi-chamber medical containers formed in Example 1 and Comparative Examples 1 to 5 were placed on a flat table surface and the medical solution side weak sealed portions 17 were opened by pressing the second container portions 12 by the palms of the hands to communicate the second container portions 12 and the first container portions 11 with each other. Then, the discharge side weak sealed portions 18 were opened by pressing the two communicated container portions 11 and 12 by the palms of the hands to communicate the two container portions 11 and 12 with the empty container portions 13.

Among the above-described operations, feeling on the hand when opening the discharge side weak sealed portion 18 was evaluated based on the following criteria.

◎(Excellent): Sufficient reinforcement effect was obtained.

○(Good): Reinforcement effect was recognized.

Δ(Fair): Reinforcement effect was recognized although the degree thereof was small.

×(Poor): No reinforcement effect was recognized.

Figure 10:
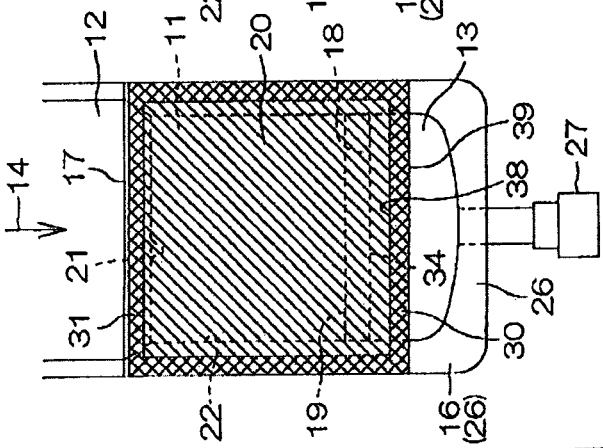
FIG. 10 contains data (Table 1) showing the reinforcement effect on the discharge side weak sealed portion in Example 1 and Comparative Examples 1 and 2.
Figure 10:
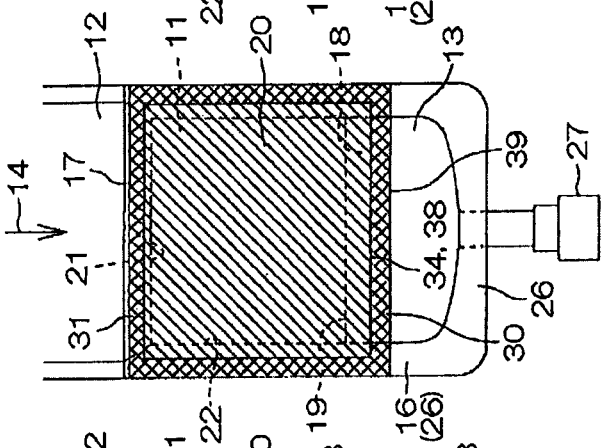
Figure 10:
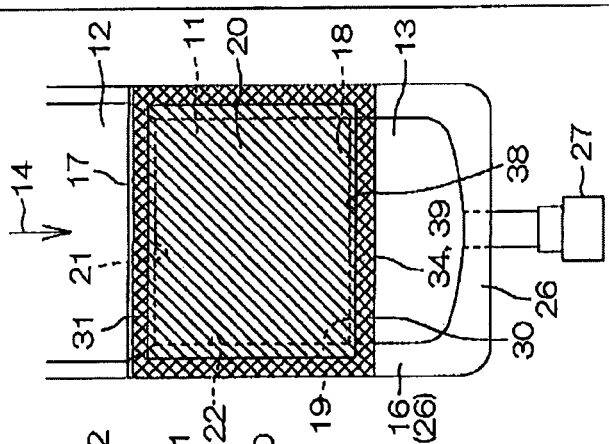
Figure 11:
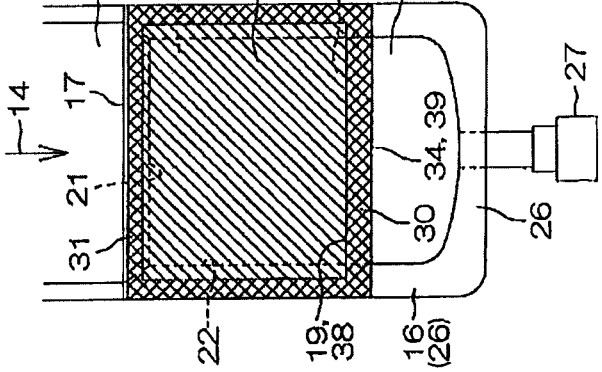
FIG. 11 contains data (Table 2) showing the reinforcement effect on the discharge side weak sealed portion in Comparative Examples 3-5.
Figure 11:
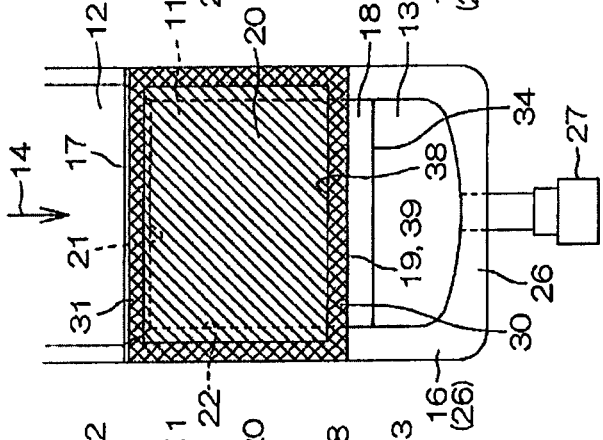
Figure 11:
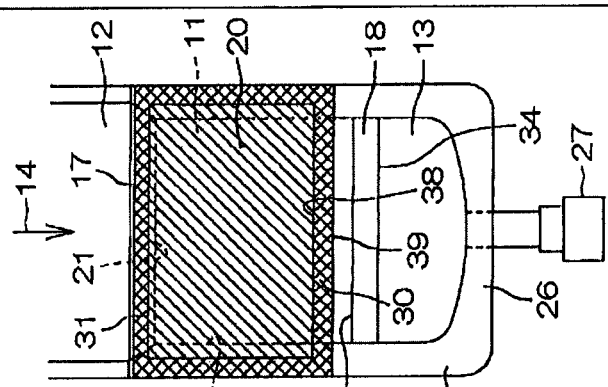

For evaluation, 10 bags of the sample were tested per one experiment example (comparative example). The results are shown in Table 1 and Table 2 (FIGS. 10 and 11).

As shown in Table 1 and Table 2, in Example 1, the reinforcement effect on the discharge side weak sealed portion 18 was excellent.

On the other hand, in Comparative Example 5, no reinforcement effect on the discharge side weak sealed portion 18 was recognized, and in Comparative Examples 1, 2 and 4, the reinforcement effect was insufficient in practical use although it was recognized.

In Comparative Example 3, the reinforcement effect on the discharge side weak sealed portion 18 was recognized, however, due to an influence from swelling of the first container portion 11, the reinforcement film 20 could not be evenly bonded, and the reinforcement effect on the discharge side weak sealed portion 18 also varied in the width direction 15 of the discharge side weak sealed portion 18.

The present invention was provided as the illustrated embodiment of the invention, however, this is only an exemplification, and its interpretation should not be limited. Variations of the invention obvious to persons skilled in the art that the invention belongs. to are included in the scope of claims shown below.

Industrial Applicability

The method for reinforcing a weak sealed portion of a multi-chamber medical container is widely preferable for use to selectively improve the peel strength of any weak sealed portion in the multi-chamber medical container including a plurality of weak sealed portions.

The invention claimed is:

1. A method for reinforcing a weak sealed portion of a multi-chamber medical container, comprising:

a multi-chamber container forming step for forming a multi-chamber medical container, including;

a first container portion for containing a medicine, a second container portion for containing a medical solution, disposed adjacent to the first container portion, an empty container portion disposed adjacent to an opposite side of the second container portion with respect to the first container portion, a pair of lateral side strong sealed portions which are disposed while spaced from each other in a width direction crossing a medical solution discharge direction from the second container portion toward the empty container portion through the first container portion, and form both side end portions of each of the container portions, a medical solution &de weak sealed portion which is provided across each of the lateral side strong sealed portions and forms a partition between the first container portion and the second container portion, and is opened when a pressure inside the second container portion becomes high, and a discharge side weak sealed portion which is provided across each of the lateral side strong sealed portions and forms a partition between the first container portion and the empty container portion, and is opened when a pressure inside the first container portion becomes high, wherein each container portion has a front surface side film and a back surface side film which are sealed by each of the sealed portions and overlapped with each other; and a reinforcement film sticking step for a sticking a reinforcement film having transparency on the surfaces of the medical solution side weaked sealed portion, the discharge side weak sealed portion, and the pair of lateral side strong sealed portions so as to cover the surface of at least either one of the front surface side film and the back surface side film of the first container portion, wherein the reinforcement film sticking step includes a step of bonding the reinforcement film to the discharge side weak sealed portion so as to be spaced from a first border of the discharge side weak sealed portion with the first container portion to the downstream side of the discharge direction by stacking only downstream side of a down edge of the reinforcement film on the discharge side weak sealed portion so as to provide a no-sticky portion between an upstream side of the down edge of the reinforcement film and the discharge side weak sealed portion while an edge of the downstream side of the reinforcement film is aligned with a second border of the discharge side weak seal portion with the empty container portion.

2. The method for reinforcing a weak sealed portion of a multi-chamber medical container according to claim 1, wherein the reinforcement film is bonded so as to cover the surfaces of both the front surface side film and the back surface side film.

3. The method for reinforcing a weak sealed portion of a multi-chamber container according to claim 2, wherein the reinforcement film is a gas barrier film which blocks permeation of air and vapor.

4. The method for reinforcing a weak sealed portion of a multi-chamber medical container according to claim 2, wherein the reinforcement film is a UV barrier film which blocks penetration of ultraviolet rays.

5. The method for reinforcing a weak sealed portion of a multi-chamber medical container according to claim 1, wherein the reinforcement film is bonded on each of the lateral side strong sealed portions so as to be spaced from borders with the first container portion outward in the width direction.

6. The method for reinforcing a weak sealed portion of a multi-chamber medical container according to claim 1, wherein the discharge side weak sealed portion has an easy-opening portion which is more easily opened than other portions by a pressure which acts on the discharge side weak sealed portion when the discharge side weak sealed portion is opened.

7. The method for reinforcing a weak sealed portion of a multi-chamber medical container according to claim 6, wherein the easy-opening portion has a projection where the discharge side weak sealed portion projects toward an upstream side of the discharge direction, and a second border of the projection at an upstream side end portion in the discharge direction with the empty container portion is disposed closer to the upstream side of the discharge direction than the first border of the discharge side weak sealed portion adjacent to the projection with the first container portion.

8. The method for reinforcing a weak sealed portion of a multi-chamber medical container according to claim 6, wherein two or more easy-opening portions are provided on the discharge side weak sealed portion.

9. The method for reinforcing a weak sealed portion of a multi-chamber medical container according to claim 1, wherein the reinforcement film sticking step further includes a step of bonding the reinforcement film to the medical solution side weak sealed portion so as to be spaced from a second border of the medical solution side weak sealed portion with the first container portion to the upstream side of the discharge direction by stacking only upstream side of an up edge of the reinforcement film on the medical solution side weak sealed portion so as to provide a no-sticky portion between a downstream side of the up edge of the reinforcement film and the medical solution side weak sealed portion.

* * * * *

UNITED STATES PATENT AND TRADEMARK OFFICE

CERTIFICATE OF CORRECTION

PATENT NO. : 9,278,051 B2
APPLICATION NO. : 12/084821
DATED : March 8, 2016
INVENTOR(S) : Fujio Inoue et al.

It is certified that error appears in the above-identified patent and that said Letters Patent is hereby corrected as shown below:

Claims

Claim 1, col. 19, line 39, "a medical solution &de weak sealed"

should read

-- a medical solution side weak sealed --.

Signed and Sealed this
Fifth Day of July, 2016

Michelle K. Lee

Michelle K. Lee
*Director of the United States Patent and Trademark Office*